US010457359B1

(12) United States Patent
Epps et al.

(10) Patent No.: US 10,457,359 B1
(45) Date of Patent: Oct. 29, 2019

(54) SYSTEM AND METHOD TO PREVENT THE BIOFOULING OF AN OUTDRIVE

(71) Applicants: Darrell Epps, Mesa, AZ (US); Scott Epps, Mesa, AZ (US)

(72) Inventors: Darrell Epps, Mesa, AZ (US); Scott Epps, Mesa, AZ (US)

( * ) Notice: Subject to any disclaimer, the term of this patent is extended or adjusted under 35 U.S.C. 154(b) by 0 days.

(21) Appl. No.: 16/001,916

(22) Filed: Jun. 6, 2018

Related U.S. Application Data

(60) Provisional application No. 62/516,010, filed on Jun. 6, 2017.

(51) Int. Cl.
*B63H 20/00* (2006.01)
*B63B 59/04* (2006.01)

(52) U.S. Cl.
CPC ..... *B63B 59/045* (2013.01); *B63H 20/00* (2013.01)

(58) Field of Classification Search
CPC ..... B63H 20/00; B63B 59/045
See application file for complete search history.

(56) References Cited

U.S. PATENT DOCUMENTS 3,220,374 A * 11/1965 Sloan ..... B63B 59/045 114/222
3,587,508 A * 6/1971 Pearce ..... B63B 59/045 440/71
3,870,875 A * 3/1975 Altimus ..... B60Q 1/30 362/477
5,791,955 A * 8/1998 Rinck ..... B63H 20/36 416/247 A
5,813,361 A * 9/1998 Milliman ..... B63J 2/12 114/361
5,964,174 A * 10/1999 Coggan ..... B63H 5/165 114/222
8,826,590 B2 * 9/2014 Cross ..... A01G 9/026 47/65.8
9,592,896 B1 * 3/2017 Scriven ..... B63H 20/32
2008/0020657 A1 * 1/2008 Williams ..... B63H 20/36 440/71
2010/0006018 A1 * 1/2010 Lathem ..... B63B 59/045 114/361

* cited by examiner

*Primary Examiner* — Stephen P Avila
(74) *Attorney, Agent, or Firm* — Booth Udall Fuller, PLC

(57) ABSTRACT

An outdrive engine enclosure having at least one sidewall forming a closed end and an open mouth opposite the closed end is disclosed. The enclosure includes a transom ligature constrictably coupled circumferentially about the at least one sidewall proximate the open mouth, and also includes at least one neck ligature constrictably coupled circumferentially about the at least one sidewall, between the open mouth and the closed end. The outdrive engine enclosure further includes a deployed configuration, where the at least one sidewall proximate the open mouth is constricted by the transom ligature around one of a transom mounting rim and a gimbal housing to form a transom seal that is substantially watertight. The deployed configuration also includes the at least one sidewall being constricted by the at least one neck ligature against the outdrive engine proximate a neck, thereby reducing the volume contained inside the enclosure in the deployed configuration.

20 Claims, 7 Drawing Sheets

SYSTEM AND METHOD TO PREVENT THE BIOFOULING OF AN OUTDRIVE

RELATED APPLICATIONS

This application claims the benefit of U.S. provisional patent application 62/516,010, filed Jun. 6, 2017 titled "SYSTEM AND METHOD TO PREVENT THE BIOFOULING OF AN OUTDRIVE," the entirety of the disclosure of which is hereby incorporated by this reference.

TECHNICAL FIELD

Aspects of this document relate generally to preventing the biofouling of an outdrive.

BACKGROUND

Zebra mussels, and other invasive species such as quagga mussels, have rapidly become an expensive problem. Zebra mussels originated from the lakes of Russia and the Ukraine, and have since spread throughout the world. First noted in the Great Lakes in the 1980s, zebra mussels have quickly spread throughout many of the major lakes of the United States. Some estimate the annual cost of dealing with zebra mussels and repairing their damage to be in the hundreds of millions of dollars in the United States alone.

Removing zebra mussels from an entire lake can be problematic. The impact of a poison on the ecosystem of an entire lake, as well as the effect of introducing a large mass of dead zebra mussels, is very difficult to predict. Also, the process of getting regulatory approval for large-scale treatment has been slow. In the meantime, boat owners are left to wage their own battle against biofouling from zebra mussels, quagga mussels, and other invasive species.

It is hard to overstate the negative impact zebra mussels have on the ecology, infrastructure, and property in infested bodies of water. Zebra mussels reproduce quickly; adult females can each produce up to a million eggs a year. The free-swimming microscopic larvae, called veligers, drift in the water before settling onto any hard surface available. With respect to boats, the biofouling is not limited to the exterior surfaces of the hull, engine, and other submerged elements. Veligers that are drawn into, or swim into, engine passages can settle in the cooling system where they can grow into adults, blocking internal screens, hoses, passages, strainers, etc. Such blockages can cause an engine to quickly overheat, and extraction and repair can be very expensive.

Performance advantages and lower cost have led to the popularity of sterndrive boats, also called I/O or inboard/outboard drive boats. The hallmark feature of a sterndrive boat is that the engine is onboard, and the rest of the propulsion system is outside of the boat, passing through the transom, with the flexible connection typically protected by a baffle or bellow device. Although most outdrives can be raised up, sometimes they are still partially in the water; furthermore, an outdrive in the raised position exposes the baffle to weather and UV damage, as well as damage from animals, birds or invasive insects and sharp objects. As such, outdrives are often left in the water when the boat is moored. In zebra mussel infested waters, such exposure can lead to degraded performance and even an inoperative cooling system. While the best way to avoid mussel problems is to remove the boat from the water and rinse it with hot water, this is not always a practical solution.

Traditional methods of preventing zebra mussel growth on drives in the water have relied on using special materials, or coating surfaces with waxy or soapy substances that prevent the veligers from bonding with the surface. However, these methods are problematic, as materials can degrade over time and can be difficult to replace; furthermore, an entire coolant system would have to be rebuilt with these materials in a traditional engine. The use of coatings can be effective, but it can be difficult to determine whether an application was sufficient before mussels have started growing. Also, the use of such substances is not feasible on the internal passages of an engine, such as the cooling system.

SUMMARY

According to one aspect, an outdrive engine enclosure includes a top sidewall, a bottom sidewall, and two side sidewalls coupled to each other and forming a closed end and an open mouth opposite the closed end. The open mouth is sized to simultaneously receive a skeg and a cavitation plate of an outdrive engine. The outdrive engine enclosure also includes a transom ligature constrictably coupled circumferentially about the sidewalls proximate the open mouth, and two neck ligatures constrictably coupled circumferentially about the sidewalls between the open mouth and the closed end. The outdrive engine enclosure further includes a transom section comprising the open mouth, the transom ligature, and a first portion of the sidewalls, the transom section coupled to a neck section along a first junction, the neck section comprising the two neck ligatures and a second portion of the sidewalls. The outdrive engine enclosure also includes a prop section coupled to the neck section along a second junction and comprising the closed end and a third portion of the sidewalls. The enclosure at the first junction narrows along at least a first path and the enclosure at the second junction expands along at least a second path. The outdrive engine enclosure further includes a deployed configuration, the deployed configuration comprising the sidewalls proximate the open mouth constricted by the transom ligature around one of a transom mounting rim and a gimbal housing of the outdrive engine to form a transom seal that is substantially watertight, and further comprising the sidewalls, between the open mouth and closed end, constricted by each of the two neck ligatures against the outdrive engine proximate a neck of the outdrive engine, thereby reducing the volume contained inside the enclosure in the deployed configuration. The neck of the outdrive engine is defined by a smallest circumference around the outdrive engine that passes between the cavitation plate and a cowling above the cavitation plate. Lastly, fluid communication between outside of the enclosure and inside of the enclosure while the enclosure is in the deployed configuration is inhibited sufficient that a veliger extinction capacity within the enclosure outpaces a rate of veliger introduction to the outdrive engine while the enclosure is in the deployed configuration.

Particular embodiments may comprise one or more of the following features. The outdrive engine enclosure may further comprise a plurality of vents proximate one of the two neck ligatures. Each vent may allow fluid communication through the sidewalls when the enclosure is not in the deployed configuration, and may be held closed by the neck ligatures when the enclosure is in the deployed configuration. The outdrive engine enclosure may further comprise at least one veliger inhibitor pocket which may be positioned on at least one sidewall inside the enclosure. The enclosure may also comprise a veliger inhibitor releasably coupled inside each of the at least one veliger inhibitor pocket. Each veliger inhibitor may be one of a deoxygenator and a veliger poison. The sidewalls may consist of PVC coated fabric, and the PVC coating is external to the enclosure. Lastly, the transom ligature and/or the two neck ligatures each may comprise a nylon strap coupled to a buckle. Each nylon strap slidably coupled to the sidewalls through a plurality of loops.

According to another aspect of the disclosure, an outdrive engine enclosure includes at least one sidewall forming a closed end and an open mouth opposite the closed end, a transom ligature constrictably coupled circumferentially about the at least one sidewall proximate the open mouth, and at least one neck ligature constrictably coupled circumferentially about the at least one sidewall between the open mouth and the closed end. The outdrive engine enclosure further includes a deployed configuration, the deployed configuration comprising the at least one sidewall proximate the open mouth constricted by the transom ligature around one of a transom mounting rim and a gimbal housing to form a transom seal that is substantially watertight. The enclosure further comprises the at least one sidewall between the open mouth and closed end constricted by the at least one neck ligature against the outdrive engine proximate a neck of the outdrive engine, thereby reducing the volume contained inside the enclosure in the deployed configuration. The neck of the outdrive engine is defined by a smallest circumference around the outdrive engine that passes between a cavitation plate and a cowling above the cavitation plate. Lastly, fluid communication between outside of the enclosure and inside of the enclosure while the enclosure is in the deployed configuration is inhibited sufficient that a veliger extinction capacity within the enclosure outpaces a rate of veliger introduction to the outdrive engine while the enclosure is in the deployed configuration.

Particular embodiments may comprise one or more of the following features. The outdrive engine enclosure may further comprise at least one unidirectional valve embedded within at least one sidewall, each of the at least one unidirectional valve may have a flow direction and may be oriented such that the flow direction is leaving the enclosure. The at least one neck ligature may comprise two neck ligatures. At least one of the at least one neck ligature and/or the transom ligature comprises an elastic material. The at least one sidewall may comprise a top sidewall, a bottom sidewall, and/or two side sidewalls. Lastly, the outdrive engine enclosure may further comprise a transom section comprising the open mouth, the transom ligature, and/or a first portion of the at least one sidewall. The transom section may be coupled to a neck section along a first junction. The neck section may comprise the at least one neck ligature and/or a second portion of the at least one sidewall. A prop section may be coupled to the neck section along a second junction and/or comprising the closed end and a third portion of the at least one sidewall. Finally, the enclosure at the first junction may narrow along at least a first path and the enclosure at the second junction expands along at least a second path.

According to yet another aspect of the disclosure, a method for inhibiting the biofouling of an outdrive engine includes running the outdrive engine until an internal temperature of at least 130° F. is reached, pulling an outdrive engine enclosure over a distal end of the outdrive engine such that a skeg and a prop of the engine pass through an open mouth of the outdrive engine enclosure. The enclosure comprising at least one sidewall forming the open mouth and a closed end opposite the open mouth. The method further includes sliding the outdrive engine enclosure up along the outdrive engine until the open mouth is proximate a transom through which the engine is coupled and the prop is proximate the closed end. The method also includes coupling the enclosure to the transom by constricting a transom ligature coupled circumferentially about and proximate to the open mouth until the at least one sidewall proximate the open mouth is pressed against at least one of a transom mounting rim and a gimbal housing to form a transom seal that is substantially watertight, reducing a volume of water trapped inside the enclosure with the engine by constricting at least one neck ligature coupled circumferentially about the at least one sidewall between the open mouth and the closed end, thereby pressing the at least one sidewall against the outdrive engine proximate a neck of the outdrive engine and placing the enclosure into a deployed configuration. The neck of the outdrive engine is defined by a smallest circumference around the outdrive engine that passes between a cavitation plate and a cowling above the cavitation plate.

Particular embodiments may comprise one or more of the following features. Putting the outdrive engine enclosure into the deployed configuration may be accomplished within 10 minutes or less of the engine achieving the internal temperature of at least 130° F. The method may further include placing a veliger inhibitor inside each of at least one veliger inhibitor pocket before pulling the enclosure over the distal end of the engine. Each of the at least one veliger inhibitor pocket may be positioned on the inside of the enclosure and/or each veliger inhibitor may be one of a deoxygenator and a veliger poison. Additionally, the method may include placing a visual reminder to prevent accidental engagement of the prop while the prop is inside of the enclosure. Finally, the method may further comprise raising the outdrive engine into a raised position.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § 112, ¶6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112, ¶6. Moreover, even if the provisions of 35 U.S.C. § 112, ¶6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DETAILED DESCRIPTION

Figure 1:
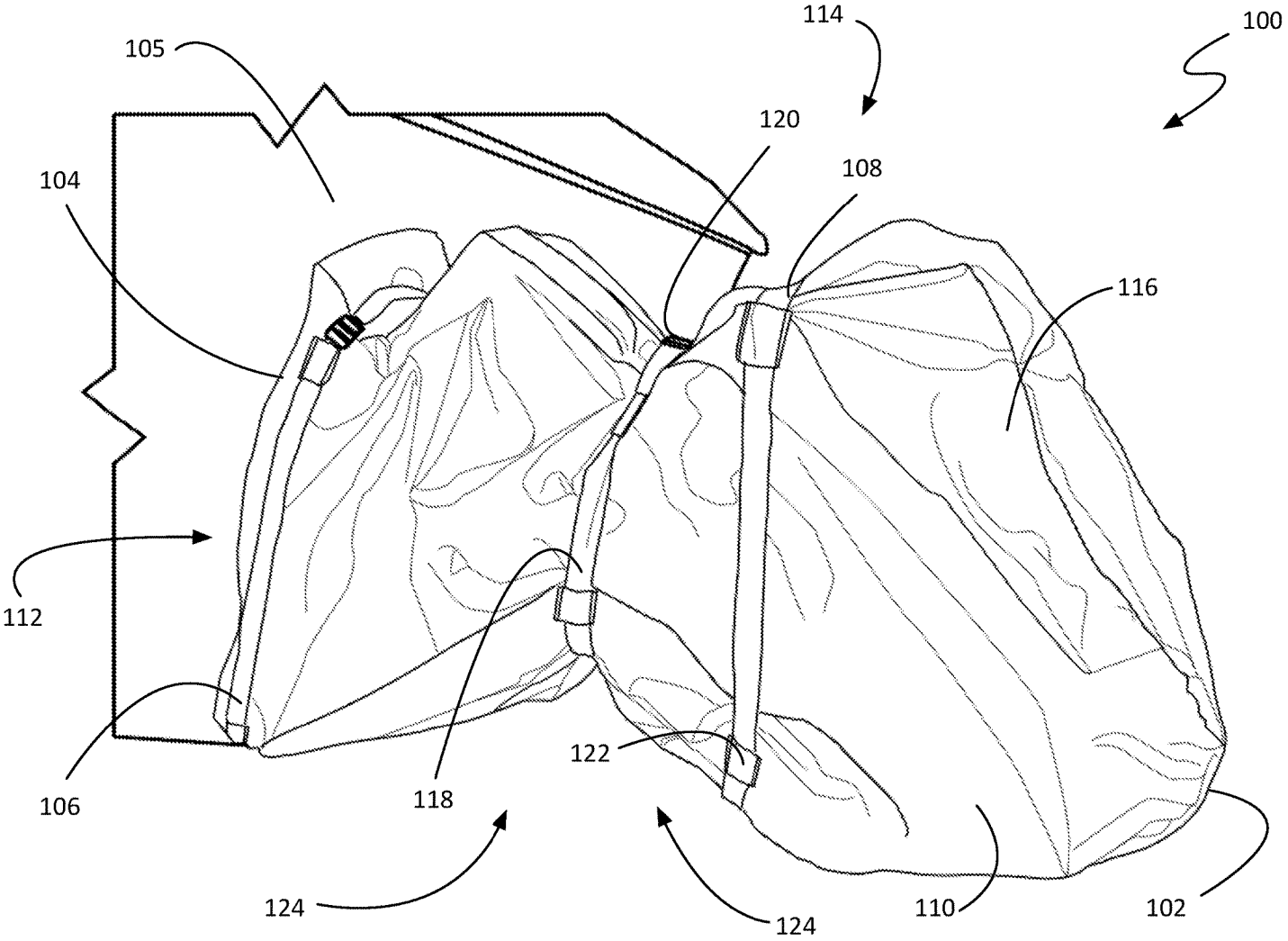
FIG. 1 is a perspective view of an outdrive engine enclosure in a deployed configuration.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

Zebra mussels, and other invasive species such as quagga mussels, have rapidly become an expensive problem. Zebra mussels originated from the lakes of Russia and the Ukraine, and have since spread throughout the world. First noted in the Great Lakes in the 1980s, zebra mussels have quickly spread throughout many of the major lakes of the United States. Some estimate the annual cost of dealing with zebra mussels and repairing their damage to be in the hundreds of millions of dollars in the United States alone.

Removing zebra mussels from an entire lake is problematic. The impact of a poison on the ecosystem of an entire lake, as well as the effect of introducing a large mass of dead zebra mussels, is very difficult to predict. Also, the process of getting regulatory approval for large-scale treatment has been slow. In the meantime, boat owners are left to wage their own battle against biofouling from zebra mussels, quagga mussels, and other invasive species.

It is hard to overstate the negative impact zebra mussels have on the ecology, infrastructure, and property in infested bodies of water. Zebra mussels reproduce quickly; adult females can each produce up to a million eggs a year. The free-swimming microscopic larvae, called veligers, drift in the water before settling onto any hard surface available. With respect to boats, the biofouling is not limited to the exterior surfaces of the hull, engine, and other submerged elements. Veligers that are drawn into, or swim into, engine passages can settle in the cooling system where they can grow into adults, blocking internal screens, hoses, passages, strainers, etc. Such blockages can cause an engine to quickly overheat, and extraction and repair can be very expensive.

Performance advantages and lower cost have led to the popularity of sterndrive boats, also called I/O or inboard/outboard drive boats. The hallmark feature of a sterndrive boat is that the engine is onboard, and the rest of the propulsion system is outside of the boat, passing through the transom, with the flexible connection typically protected by a baffle or bellow device. Although most outdrives can be raised up, sometimes they are still partially in the water; furthermore, an outdrive in the raised position exposes the baffle to weather and UV damage, as well as damage from animals, birds or invasive insects and sharp objects. As such, outdrives are often left in the water when the boat is moored. In zebra mussel infested waters, such exposure can lead to degraded performance and even an inoperative cooling system. While the best way to avoid mussel problems is to remove the boat from the water and rinse it with hot water, this is not always a practical solution.

Traditional methods of preventing zebra mussel growth on drives in the water have relied on using special materials, or coating surfaces with waxy or soapy substances that prevent the veligers from bonding with the surface. However, these methods are problematic, as materials can degrade over time and can be difficult to replace; furthermore, an entire coolant system would have to be rebuilt with these materials in a traditional engine. The use of coatings can be effective, but it can be difficult to determine whether an application was sufficient before mussels have started growing. Also, the use of such substances is not feasible on the internal passages of an engine, such as the cooling system.

Contemplated herein is a system and method for preventing the biofouling of an outdrive. According to various embodiments, the system comprises an outdrive enclosure and may further comprise at least one veliger inhibitor. Advantageously, the outdrive enclosure may be used to isolate a heated outdrive from the body of water in which it rests. Specifically, embodiments of the outdrive enclosure isolate the outdrive and all entry points to the cooling system from the surrounding body of water. Such isolation is advantageous over traditional methods of preventing zebra mussel incursion, in that it allows for the use of water-based methods otherwise impractical or illegal to use in open water. Furthermore, the outdrive enclosure is easy to deploy, and may also serve to protect the outdrive from weather and UV damage. By enclosing the outdrive, only the veligers captured inside the enclosure need to be dealt with, rather than a steady current of veligers passing by an unprotected outdrive.

While the non-limiting embodiments discussed herein are directed for use with the outdrive of a sterndrive boat, these systems and methods may be adapted for use with other types of boat drives and engines known in the art. Furthermore, the following discussion will refer to zebra mussels, but should be understood to also apply to other invasive bivalves such as the quagga mussel, as well as other biofouling vectors such as barnacles and the like.

FIG. 1 shows a perspective view of non-limiting example of an outdrive engine enclosure 100. This particular embodiment is shown in a deployed configuration 114, meaning it has been applied to the outdrive engine of a boat. As shown, the outdrive engine enclosure 100 comprises an open mouth 104 and a closed end 102 defined by and composed of one or more sidewalls 110. The enclosure 100 further comprises a transom ligature 106 and at least one neck ligature 108.

As previously mentioned, FIG. 1 shows an outdrive engine enclosure 100 in a deployed configuration 114. In the context of the present disclosure and the claims that follow, a deployed configuration 114 of an enclosure 100 is when the enclosure 100 has been applied to the engine in such a way that fluid communication between the exterior of the enclosure 100 and the interior of the enclosure 100, if any, is small enough that the introduction of new veligers does not outpace the rate at which they are being exterminated within the enclosure 100. Such a configuration may also be described as being "substantially watertight".

According to various embodiments, the degree to which water flow is restricted depends upon the intended use environment. For example, embodiments intended for use on watercraft stored in turbulent water (e.g. ocean, large bodies of water exposed to high winds, etc.) may, out of necessity, comprise materials (e.g. sidewalls, ligatures, etc.) and construction that provides a greater attenuation of fluid communication than embodiments intended for use in calmer circumstances, where more porous materials/construction may be sufficient. However, all embodiments, when in the deployed configuration 114 in their intended use environment, may be described as substantially or sufficiently watertight.

FIG. 1 depicts the enclosure 100 in a deployed configuration 114 while the engine is in a raised position 124. According to various embodiments, the enclosure 100 may be used on an engine while it is in a raised or lowered position.

As shown in FIG. 1, the outdrive enclosure 100 may be shaped to conform to the profile of an outdrive engine. In some embodiments, the outdrive enclosure 100 may be sized and shaped to work with a range of popular outdrive shapes and sizes. In other embodiments, the outdrive enclosure 100 may be "bespoke", sized to fit a particular outdrive close enough to reduce the enclosed volume yet loose enough that application is not difficult.

In some embodiments, the open mouth 104 may be sized such that the cavitation plate and the skeg of the engine can pass through the open mouth 104 at the same time. In many outdrive engines, this would represent the widest, and possibly most difficult, part of the engine to insert through an aperture such as the open mouth 104. Sizing the outdrive enclosure for a specific outdrive may be advantageous, as an enclosure that is too large may result in trapped volumes of water, which may protect veligers from the inhibitor and allow them to later infest the outdrive.

If the outdrive enclosure 100 is allowed to move with the surrounding water currents, the jostling may compromise the transom seal 112 and allow veliger-infested water to enter the enclosure 100 and outdrive 200. According to various embodiments, the outdrive engine enclosure 100 may employ a number of ligatures to secure the enclosure in place, as well as to minimize the volume of veliger-laden water trapped inside after installation.

In the context of the present description and the claims that follow, a ligature is an object used to tightly tie or bind part of the enclosure 100 to another object, such as the transom or the engine itself. Examples of ligatures include, but are not limited to, straps, belts, ropes, cables, elastics, and the like.

As shown in FIG. 1, an outdrive engine enclosure 100 may comprise two kinds of ligatures: a transom ligature 106 and at least on neck ligature 108. In the context of the present description and the claims that follow, a transom ligature 106 is a ligature that is coupled to the one or more sidewalls 110 of the enclosure along or near the perimeter of the open mouth 104. The transom ligature 106 is used to secure the open mouth 104 of the enclosure 100 to the engine or the boat transom to which the engine is coupled, creating a transom seal 112 that prevents the interior of the enclosure 100, as well as the engine itself, from being overrun by veligers. In some embodiments, the transom ligature 106 is constrictably coupled to the sidewalls 110, meaning it is coupled to the sidewalls 110 yet still able to constrict around the sidewalls 110 (until they are pinned against another structure such as the transom or the engine itself). In other embodiments, the transom ligature 106 may be functionally attached to the sidewalls 110 in such a way that the ligature 106 is coupled to the enclosure 100 while still being free to reduce the size of the enclosure 100 in a fashion other than constriction (e.g. wrapping, etc.).

In addition to a transom ligature 106, some embodiments also include at least one neck ligature 108. In the context of the present description and the claims that follow, a neck ligature 108 is a ligature that is coupled to the one or more sidewalls 110 of the enclosure 100 circumferentially, somewhere between the open mouth 104 and the closed end 102. More specifically, according to various embodiments, neck ligatures 108 are positioned with respect to the sidewalls 110 such that when the enclosure 100 is in a deployed configuration 114, the neck ligatures 108 are proximate the neck of the engine. See, for example, the neck 214 of the outdrive engine 200 of FIG. 2. Neck ligatures may be used to reduce the internal volume of the enclosure 100 after it has been placed over an outdrive engine, such as the engine 200 of FIG. 2. For example, according to various embodiments, a neck ligature 108 may press the one or more sidewalls 110 against the body of the engine.

Figure 2:
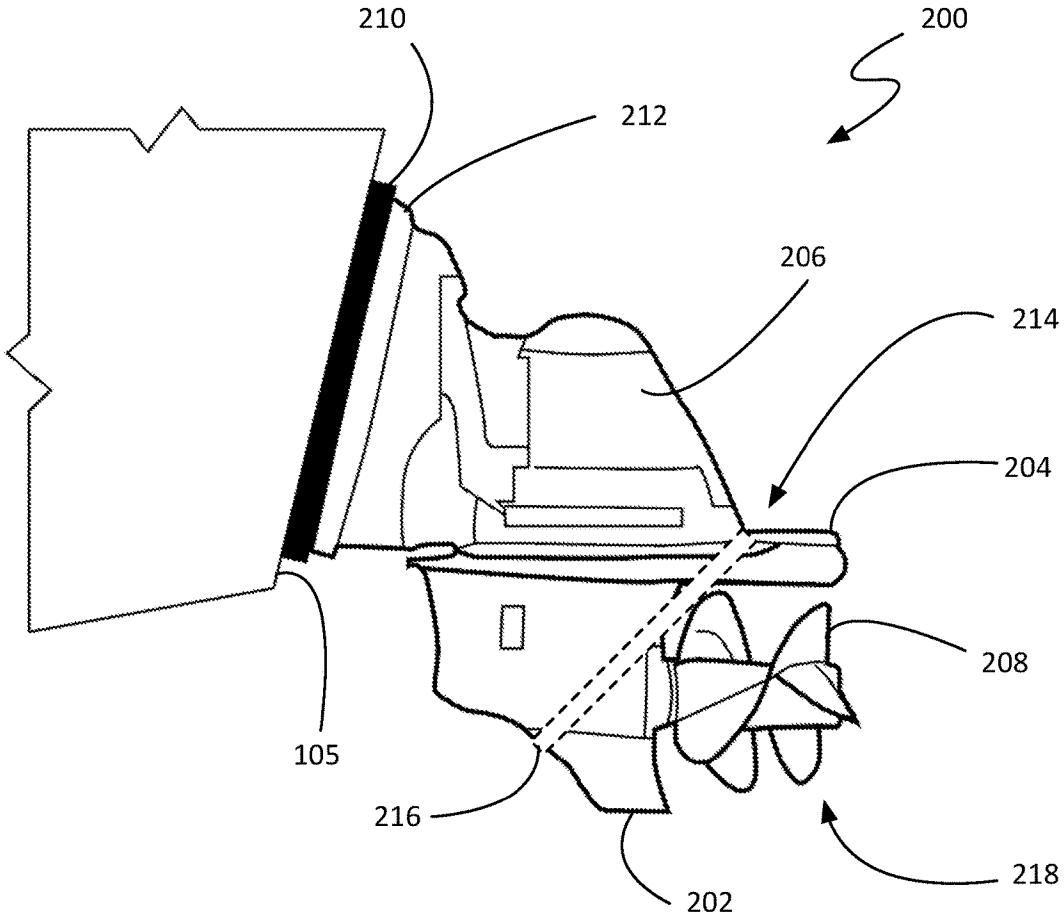
FIG. 2 is a side view of an exemplary outdrive engine coupled to a transom.

According to various embodiments, and as shown in FIG. 2, the neck 214 of an outdrive engine 200 is defined by a smallest circumference 216 around the outdrive engine 200 that passes between a cavitation plate 204 and a cowling 206 above the cavitation plate 204. The neck 214 often represents a narrowing in the profile of the engine 200; a ligature applied near the neck 214 will be more secure and less likely to slip off due to jostling.

In the non-limiting example shown in FIG. 1, the neck ligatures 108 and the transom ligature 106 are all nylon straps 118, each having a buckle 120 and constrictably coupled to the sidewalls 110 through a plurality of loops 122.

Some embodiments may comprise one, two, three, four, or more straps 118 to secure the outdrive enclosure 100 to the outdrive 200. The straps 118 and/or buckles 120 may be composed of any material known in the art for securing or cinching in an aquatic environment. In some embodiments, the straps 118 may be elastic in nature. Additionally, in some embodiments, the enclosure 100 may comprise some form of cushioning material on the inside, opposite the straps 118, which may serve to protect the finish of the outdrive 200 from abrasion or damage.

FIG. 1 shows the straps 118 being coupled to the outdrive enclosure 100 through a plurality of strap loops. According to various embodiments, the straps may be coupled to the body through loops, rings, apertures, or the like. In some embodiments, the straps may be incorporated into the enclosure body, such that they are at least partially within the walls of the body.

According to various embodiments, the transom seal 112 is the portion of the outdrive enclosure 100 that couples with or near the transom such that water is not able to freely flow between the inside of the deployed enclosure 100 and the outside. Typically, the area where the outdrive passes through the transom is protected by a flexible baffle, and the baffle interfaces with the transom such that there is a rim (e.g. transom mounting rim 210 of FIG. 2) on the transom around the perimeter of the baffle. In some embodiments, the transom seal 112 couples with this rim. In other embodiments, the transom seal 112 may couple with some other part of the transom, baffle, or outdrive such that water is not able to flow into the deployed enclosure. For example, in one embodiment, the transom seal 112 may form on a gimbal housing 212 of the outdrive engine 200.

The formation of the transom seal 112 is advantageous, as it limits the volume of water (and thus, number of veligers) that must be dealt with to protect the outdrive 200 from mussel infestation. By limiting the volume of water, the magnitude of required veliger inhibition is reduced. The role of inhibitors 408 will be discussed in greater detail below.

In some embodiments, the open mouth 104 may be watertight. In other embodiments, the open mouth 104 may allow only a small amount of water flow after the transom seal 112 has been formed, so long as it does not outpace whatever method of veliger inhibition is being used within the enclosure 100. In some embodiments, the open mouth 104 may comprise a material conducive to forming a seal of sufficient strength, such as a rubber or foam rubber material.

In the non-limiting example shown in FIG. 1, the transom ligature 106 comprises a nylon strap 118 and buckle 120. Other embodiments may use an elastic strap, a ratcheting buckle, and/or any other securing methods known in the art. In one embodiment, the transom seal 112 may comprise a combination of rubberized seal and a series of magnets that may couple with a series of magnets embedded or coupled to the transom. The use of magnets may be advantageous, as they may help ensure consistent positioning of the open mouth 104 to form the transom seal 112 (e.g. if all the magnets are aligned then the seal is uniform, etc.). In other embodiments, the open mouth 104 may be releasably coupled to the transom or proximate to the transom through various means, including but not limited to, magnets, adhesives, suction cups, clips, snaps, and/or anchors.

In some embodiments of the outdrive engine enclosure 100, the enclosure 100 may further comprise one or more transom aperture covers. In the context of the present description and the claims that follow, a transom aperture may refer to any opening providing fluid communication between the surrounding body of water and the internal pathways of the boat or engine, such as a cooling intake or the exhaust system. According to various embodiments, when the outdrive enclosure 100 is fully deployed, a transom aperture cover is coupled to the transom and prevents or significantly reduces (e.g. reduced such that a veliger inhibitor can neutralize any incoming veligers, etc.) the flow of water through one or more transom apertures.

In some embodiments, a transom aperture cover may releasably couple with the structure proximate the one or more transom apertures through a variety of means, including but not limited to the means discussed above with respect to the releasable coupling of the open mouth 104 to the transom. In other embodiments, a transom aperture cover may be pressed against one or more transom apertures. For example, the transom aperture cover may comprise a rigid or semi-rigid biasing element, such that the outdrive enclosure 100 may be deployed while the outdrive 200 is in a raised position 124, and then the covered outdrive is lowered to the down position, the transom aperture cover is pressed against the one or more transom apertures by the biasing element trapped between the outdrive 200 and the transom 105, preventing the flow of water without damaging the boat. As an option, a transom aperture cover may be composed of a rubber or elastomer material, to facilitate the creation of a seal.

The sidewalls 110 of the outdrive enclosure 100 may be composed of any water-tight material known in the art, including but not limited to plastic, resin, fabric, coated fabric, fiberglass, composite materials, rubber, and/or any other material known in the art. In some embodiments, the outdrive enclosure 100 may be composed, or partially composed, of a rigid material, providing greater mechanical protection to the outdrive 200. In other embodiments, including the non-limiting examples shown in FIG. 1, the outdrive enclosure 100 may be composed of a flexible material. In some embodiments, the enclosure may be flexible enough to fold for storage. Furthermore, in some embodiments, the outdrive enclosure 100 may be composed of a material able to withstand various methods of zebra mussel decontamination, including but not limited to, application of hot (e.g. 140° F.) water, freezing, and/or chemical rinses (e.g. chlorine solution, etc.).

Some embodiments of the outdrive enclosure may be composed of a PVC coated fabric 116, such as a lightweight polyester fabric, which may provide strength and durability. As an option, the coating may be both UV resistant as well as inhibit the growth of mildew. In some embodiments, the PVC coating may be on the outside of the enclosure 100. As a specific example, the outdrive enclosure 100 may be composed of PVC coated polyester 116 having a weight of 18 oz. per square yard. The use of a PVC coated fabric 116 is advantageous, as punctures may be easily repaired with conventional PVC patch kits.

FIG. 1 shows an outdrive enclosure 100 deployed on a boat that is on land. The use of an outdrive enclosure 100 on a boat in dry storage may be advantageous, as the enclosure 100 may protect sensitive parts, including but not limited to the baffle, from weather damage, UV damage, invasion of insects, and animals. However, it should be understood that the outdrive enclosure 100 is also meant to be used on an outdrive 200 of a boat moored in zebra mussel infested water.

FIG. 2 shows a side view of a non-limiting example of an outdrive engine 200 comprising a skeg 202, a cavitation plate 204, a cowling 206 above the cavitation plate 204, a prop 208, a transom mounting rim 210, a gimbal housing 212, and a neck 214.

As shown in FIG. 2, and as previously discussed, the neck 214 of an outdrive engine 200 is defined by a smallest circumference 216 around the outdrive engine 200 that passes between a cavitation plate 204 and a cowling 206 above the cavitation plate 204. The neck 214 often represents a narrowing in the profile of the engine 200; a ligature applied near the neck 214 will be more secure and less likely to slip off due to jostling.

Figure 3:
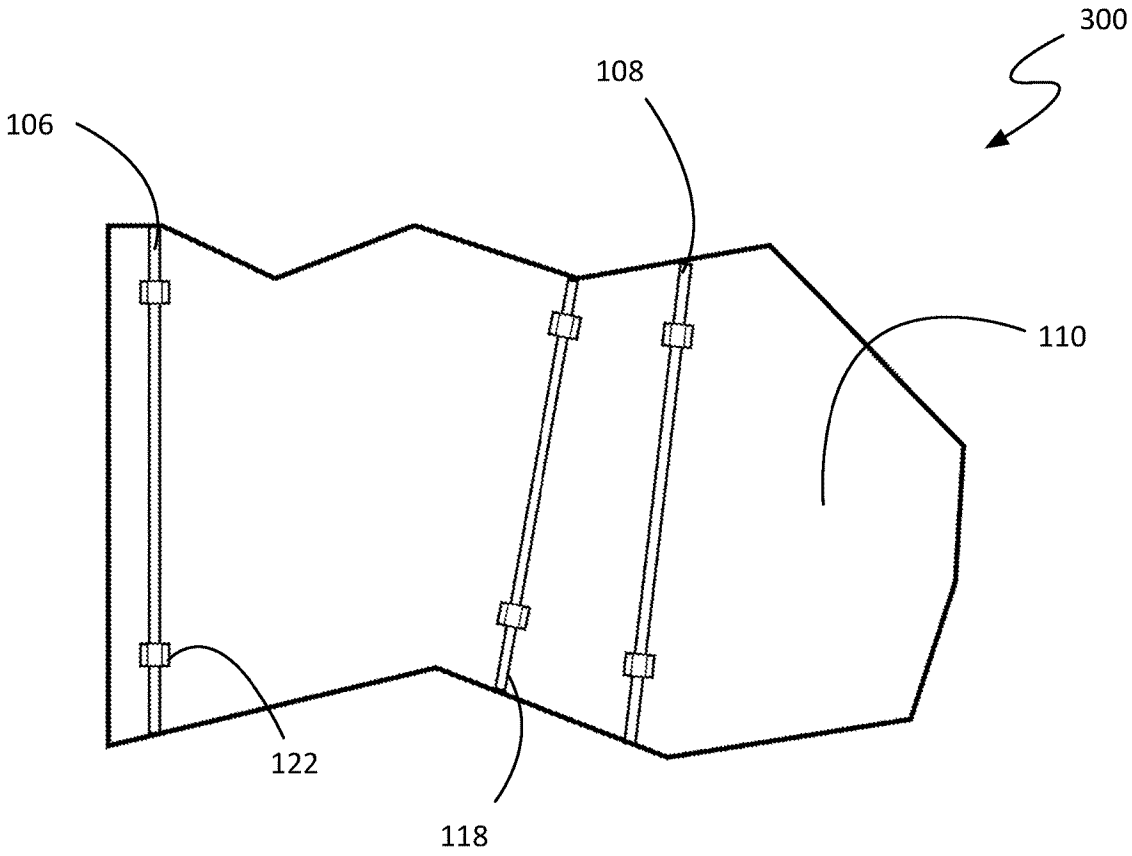
FIG. 3 is a schematic view of a side sidewall.
Figure 4:
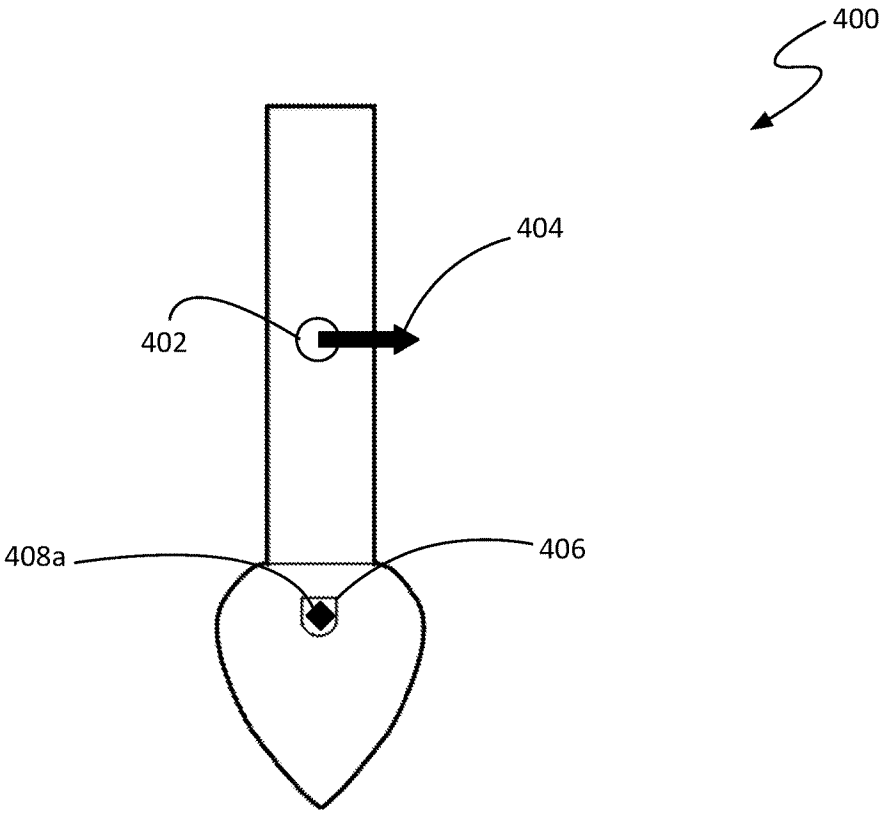
FIG. 4 is a schematic view of a top sidewall.
Figure 5:
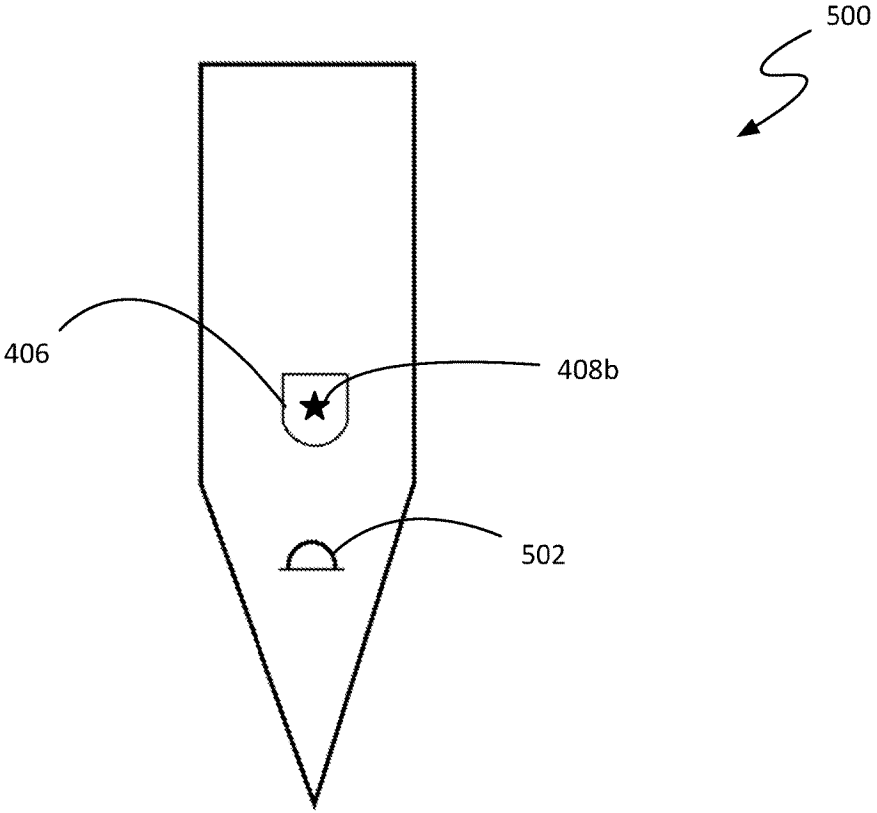
FIG. 5 is a schematic view of a bottom sidewall.

In some embodiments, the outdrive engine enclosure 100 may be constructed from a single piece of material. In other embodiments, the outdrive engine enclosure 100 may be constructed from multiple sidewalls. For example, the non-limiting embodiment shown in FIG. 1 comprises four sidewalls. FIGS. 3-5 show schematic views of a side sidewall 300, a top sidewall 400, and a bottom sidewall 500. Other embodiments may make use of two, three, five, six, or more sidewalls 110.

As shown, the outdrive enclosure 100 comprises one or more veliger inhibitor pockets 406 on the inside of the enclosure body. As shall be discussed in greater detail with respect to the method, the veligers inside the outdrive 200 may be killed by raising the temperature of the engine 200 before deploying the outdrive enclosure 100. However, as the enclosure 100 may be deployed while the outdrive 200 is in the water, the deployed enclosure 100 likely includes water that may contain veligers unharmed by the internal temperature of the engine 200. The inhibitor pockets 406 hold one or more means for inhibiting the veligers from infesting the engine 200 after the enclosure 100 is deployed. Such inhibition may include preventing growth, or even killing the veligers. Because the outdrive enclosure 100 limits the volume of water that needs to be treated, inhibition means, methods, and materials normally too weak to be effective may be of use, and traditional methods may be employed in a greatly reduced capacity, as will be discussed.

In some embodiments, the inhibitor pockets 406 may be composed of the same material as the enclosure sidewalls 110. In other embodiments, the inhibitor pockets 406 may be composed of a material that facilitates fluid communication between an inhibitor 408 stored in the pocket 406 and the rest of the enclosed water. For example, in one embodiment, the inhibitor pockets 406 may be composed of a nylon mesh. In some embodiments, the inhibitor pockets 406 may be closable (e.g. zipper, snap, hook and loop, button, drawstring, etc.) while in others the pockets 406 may be open.

Embodiments of the enclosure 100 may comprise one, two, three, four, five, or more inhibitor pockets 406. The inhibitor pockets 406 may be uniform, or they may differ from each other to contain different types of inhibitors 408. In some embodiments, the outside of the enclosure 100 may have a visual indication of the location of the internal inhibitor pockets 406, to facilitate tactile verification of the presence of an inhibitor 408 (e.g. to make sure it wasn't forgotten, to determine if a dissolving inhibitor 408 is still present, etc.).

The outdrive enclosure 100 may further comprises at least one releasable vent 502, as shown in FIG. 5. The releasable vent 502 allows the water inside the outdrive enclosure 100 to drain while facilitating the application and removal of the outdrive enclosure 100 (e.g. allowing water to drain when trying to lift the enclosure 100 up and around the engine 200, etc.). In some embodiments, the vent 502 may be a valve or flap in the bottom surface of the enclosure. As a specific example, in one embodiment, the vent 502 may be beneath a strap, such as a neck ligature 108, such that when the strap is cinched tight, the vent 508 is held closed, but when the neck ligature 108 is loosened, the vent 502 may freely open. In other embodiments, the vent 502 may be a one-way vent 402 (e.g. unidirectional vent 402 of FIG. 4, etc.), designed to only allow water to exit the enclosure, but preventing any veliger tainted water from entering. In other embodiments, other vents 502 known in the art may be used, so long as they may be closed to prevent water from entering the enclosure 100 after the enclosure 100 has been deployed.

Other embodiments may employ one-way, or unidirectional valves 402 to facilitate application and subsequent compression of the enclosure 100 in an aquatic environment. The unidirectional valves 402, which only allow water to flow through them in a single flow direction 404, may be placed in one or more sidewalls 110, such that water may escape from inside the enclosure 100 through the unidirectional valve 402, but may not enter along the same path. The unidirectional valve 402 may be any one-way valve known in the art that is compatible with the other materials of the enclosure 100.

According to various embodiments, the system for preventing the biofouling of an outdrive engine 200 may also include one or more veliger inhibitors 408. A veliger inhibitor 408 is a device, substance, or compound which may prevent a veliger from growing large enough to damage a boat engine. In some embodiments, this is accomplished by killing the veliger, while in others it may be accomplished by depriving the veliger from a needed component for its growth. Some embodiments of the system make use of one type of veliger inhibitor 408, while others may make use of multiple types or forms of inhibitors 408. The inhibitors 408 only need be potent enough to inhibit the veligers contained in the enclosed water, as the transom seal 112 may prevent any additional veligers from entering after the enclosure 100 has been deployed.

One non-limiting example of a veliger inhibitor 408 is an organic infuser pouch, which may contain one or more organic compounds known to inhibit the growth of mussel larvae. Such compounds may include, but are not limited to, cayenne pepper, cinnamon, ginger, turmeric, wormwood, black walnut hulls, clove, garlic, ground heirloom cucumber seeds, ground papaya seeds, and raw pumpkin seeds. As a specific example, an infuser pouch may contain 2 tablespoons of cayenne pepper, and one teaspoon each of cinnamon, ginger, and turmeric. The infuser pouch may be composed of a paper or cloth material, similar to a tea bag, according to various embodiments. After deployment, the enclosed water is slowly infused with the organic compounds, inhibiting veliger infestation of the engine. This form of inhibitor 408 may be advantageous over conventional methods, as it is natural, biodegradable, and inexpensive to use on such a limited volume of water.

Since the veliger inhibitor 408 only needs to affect the small volume of water contained within the outdrive enclosure 100, options otherwise unavailable to boaters in protecting their property may be used. For example, mussel poisons 408*b*, such as the poisons derived from bacteria, are prohibited from use on a large scale. However, the small amount needed to treat the enclosure 100 may be granted regulatory permission sooner than the broad application to a lake. This applies to any of the other inhibitors 408 known in the art as well.

Another example of a veliger inhibitor 408 is a deoxygenator 408*a*, which may deoxygenate the enclosed water to the point that it no longer is able to sustain the life of mussel larvae. In some embodiments, such a veliger inhibitor 408 may be reusable, releasing the captured oxygen upon the application of a stimulus such as heat. Yet another example of a veliger inhibitor 408 may function to heat the enclosed water to a temperature sufficient to kill the trapped veligers.

Figure 6:
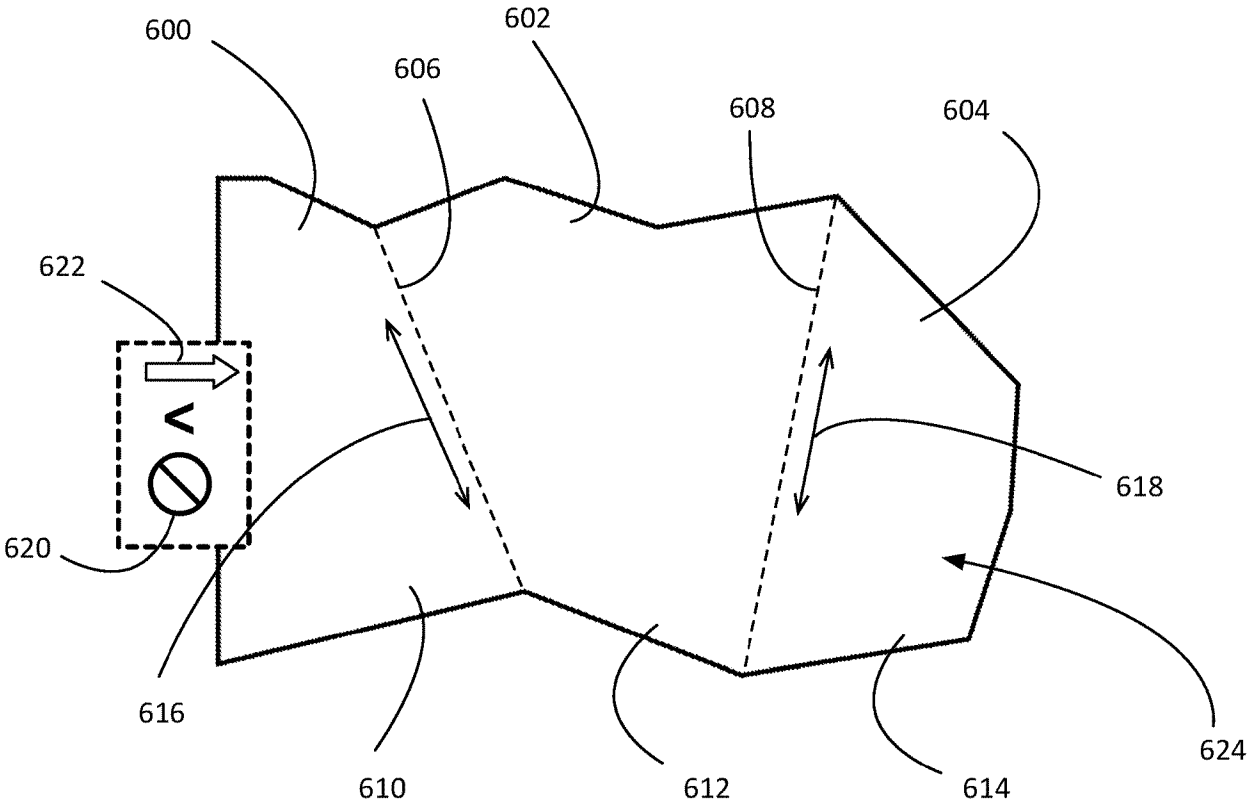
FIG. 6 is a schematic view of a partitioned outdrive engine enclosure.

FIG. 6 shows a schematic side view of a non-limiting example of an outdrive engine enclosure 100. As shown, the enclosure 100 may be partitioned into three sections: a transom section 600, a neck section 602, and a prop section 604. According to various embodiments, the transom section 600 includes the open mouth 104, the transom ligature 106, and a first portion 610 of the at least one sidewall. The transom section is coupled to the neck section 602 along the first junction 606, and includes at least one neck ligature 108 and a second portion 612 of the at least one sidewall 110. The prop section 604 is coupled to the neck section 602 along a second junction 608 and includes the closed end 102 and a third portion 614 of the at least one sidewall 110.

According to various embodiments, the outdrive engine enclosure 100 may have a variety of shapes. For example, in one embodiment, the enclosure 100 may be uniform across the three sections, essentially forming a cylinder. In other embodiments, the shape of the enclosure may be modified to reduce the amount of wasted space inside the enclosure 100. As the volume 624 of water trapped within the enclosure 100 after it has been put into the deployment configuration decreases, veliger inhibition efforts may become more effective and efficient.

For example, in the embodiment shown in FIG. 6, the enclosure 100 at the first junction 606 narrows along at least a first path 616 and the enclosure at the second junction 608 expands along at least a second path 618. In this way, the irregular shape of an outdrive engine may be better fit by the enclosure, reducing wasted space. Such a reduction may serve to eliminate the veligers inside the enclosure 100. Maintenance of such an elimination may be accomplished by reducing the waste volume such that a veliger extinction capacity 620 outpaces the rate of veliger introduction 622 to the enclosed outdrive engine.

Further contemplated in this disclosure is a method for employing the previously discussed enclosures 100 to prevent the biofouling of an outdrive 200 by zebra mussels. The following discussion is in the context of a single engine boat, but it should be clear to one skilled in the art that these systems and methods may be applied to boats having multiple engines.

Figure 7:
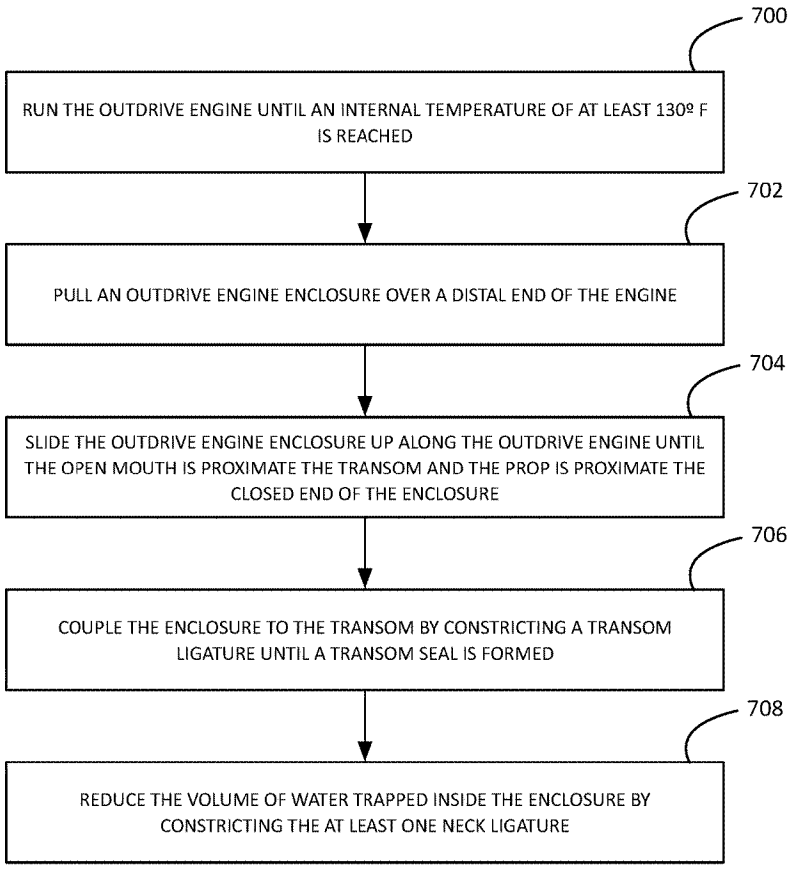
FIG. 7 is a process flow for preventing biofouling of an outdrive engine.

FIG. 7 shows a non-limiting example of a process flow for preventing biofoulding of an outdrive 200. First, the outdrive engine 200 is run until an internal temperature sufficient to kill any larvae that have infiltrated the internal passages has been reached. See step 700. According to some embodiments, this temperature may be at least 130° F., while in others it is over 140° F. As a specific example, an engine may be run at idle for 10 minutes to achieve a target temperature.

Next, the outdrive engine enclosure is pulled up over a distal end of the engine. See step 702. This may be done while the outdrive is in a down position, or an up position, which may be more convenient depending on the particular shape and size of the outdrive. The outdrive enclosure needs to be in place before the internal temperature of the engine has dropped to the level where larvae may survive. In some embodiments, this may be between five and ten minutes after the engine is stopped.

As an option, before step 702, one or more inhibitors may be placed in the inhibitor pockets on the inside of the outdrive enclosure. In some embodiments, the inhibitors may need to be replaced before each deployment of the outdrive enclosure, while in others, the inhibitors may last through multiple deployments and may only need replacement once depleted or inert.

The enclosure is then slid up along the outdrive engine 200 until the open mouth 104 is proximate the transom 105 and the prop is proximate the closed end 102 of the enclosure 100. See step 704.

Next, the enclosure 100 is coupled to the transom 105 by constricting a transom ligature 106 until a transom seal 112 is formed. See step 706. Once the enclosure is over the outdrive and at least partially filled with water, the transom seal is secured to the transom (or, in some embodiments, secured to an object proximate the transom) such that water flow is discouraged. The heat of the engine will have killed any veligers on the inside.

Finally, the volume of trapped water is reduced by constricting the neck ligatures 108. See step 708. In some embodiments, a reminder may be placed over the boat throttle, to prevent anyone from accidentally starting the engine with the outdrive enclosure in place.

It will be understood that implementations are not limited to the specific components disclosed herein, as virtually any components consistent with the intended operation of a method and/or system implementation for preventing the biofouling of an outdrive may be utilized. Accordingly, for example, although particular outdrive enclosures and inhibitors may be disclosed, such components may comprise any shape, size, style, type, model, version, class, grade, measurement, concentration, material, weight, quantity, and/or the like consistent with the intended operation of a method and/or system implementation for preventing the biofouling of an outdrive may be used. In places where the description above refers to particular implementations of outdrive enclosures and veliger inhibitors, it should be readily apparent that a number of modifications may be made without departing from the spirit thereof and that these implementations may be applied to other enclosures and inhibitors.

Where the above examples, embodiments and implementations reference examples, it should be understood by those of ordinary skill in the art that other biofouling prevention systems, methods and examples could be intermixed or substituted with those provided. In places where the description above refers to particular embodiments of outdrive engine enclosures and customization methods, it should be readily apparent that a number of modifications may be made without departing from the spirit thereof and that these embodiments and implementations may be applied to other to biofouling prevention technologies as well. Accordingly, the disclosed subject matter is intended to embrace all such alterations, modifications and variations that fall within the spirit and scope of the disclosure and the knowledge of one of ordinary skill in the art.

What is claimed is:

1. An outdrive engine enclosure, comprising:

a top sidewall, a bottom sidewall, and two side sidewalls coupled to each other and forming a closed end and an open mouth opposite the closed end, the open mouth sized to simultaneously receive a skeg and a cavitation plate of an outdrive engine;

a transom ligature constrictably coupled circumferentially about the sidewalls proximate the open mouth;

two neck ligatures constrictably coupled circumferentially about the sidewalls between the open mouth and the closed end;

a transom section comprising the open mouth, the transom ligature, and a first portion of the sidewalls, the transom section coupled to a neck section along a first junction, the neck section comprising the two neck ligatures and a second portion of the sidewalls; and a prop section coupled to the neck section along a second junction and comprising the closed end and a third portion of the sidewalls;

wherein the enclosure at the first junction narrows along at least a first path and the enclosure at the second junction expands along at least a second path;

wherein the outdrive engine enclosure further comprises a deployed configuration, the deployed configuration comprising the sidewalls proximate the open mouth constricted by the transom ligature around one of a transom mounting rim and a gimbal housing of the outdrive engine to form a transom seal that is substantially watertight, and further comprising the sidewalls, between the open mouth and closed end, constricted by each of the two neck ligatures against the outdrive engine proximate a neck of the outdrive engine, thereby reducing the volume contained inside the enclosure in the deployed configuration;

wherein the neck of the outdrive engine is defined by a smallest circumference around the outdrive engine that passes between the cavitation plate and a cowling above the cavitation plate;

wherein fluid communication between outside of the enclosure and inside of the enclosure while the enclosure is in the deployed configuration is inhibited sufficient that a veliger extinction capacity within the enclosure outpaces a rate of veliger introduction to the outdrive engine while the enclosure is in the deployed configuration.

2. The outdrive engine enclosure of claim 1, further comprising a plurality of vents proximate one of the two neck ligatures, wherein each vent allows fluid communication through the sidewalls when the enclosure is not in the deployed configuration, and is held closed by the neck ligatures when the enclosure is in the deployed configuration.

3. The outdrive engine enclosure of claim 1, further comprising at least one veliger inhibitor pocket positioned on at least one sidewall inside the enclosure; and a veliger inhibitor releasably coupled inside each of the at least one veliger inhibitor pocket, each veliger inhibitor being one of a deoxygenator and a veliger poison.

4. The outdrive engine enclosure of claim 1, wherein the sidewalls consist of PVC coated fabric, and wherein the PVC coating is external to the enclosure.

5. The outdrive engine enclosure of claim 1, wherein the transom ligature and the two neck ligatures each comprise a nylon strap coupled to a buckle, each nylon strap slidably coupled to the sidewalls through a plurality of loops.

6. An outdrive engine enclosure, comprising:

at least one sidewall forming a closed end and an open mouth opposite the closed end;

a transom ligature constrictably coupled circumferentially about the at least one sidewall proximate the open mouth; and at least one neck ligature constrictably coupled circumferentially about the at least one sidewall between the open mouth and the closed end;

wherein the outdrive engine enclosure further comprises a deployed configuration, the deployed configuration comprising the at least one sidewall proximate the open mouth constricted by the transom ligature around one of a transom mounting rim and a gimbal housing to form a transom seal that is substantially watertight, and further comprising the at least one sidewall between the open mouth and closed end constricted by the at least one neck ligature against the outdrive engine proximate a neck of the outdrive engine, thereby reducing the volume contained inside the enclosure in the deployed configuration;

wherein the neck of the outdrive engine is defined by a smallest circumference around the outdrive engine that passes between a cavitation plate and a cowling above the cavitation plate; and wherein fluid communication between outside of the enclosure and inside of the enclosure while the enclosure is in the deployed configuration is inhibited sufficient that a veliger extinction capacity within the enclosure outpaces a rate of veliger introduction to the outdrive engine while the enclosure is in the deployed configuration.

7. The outdrive engine enclosure of claim 6, further comprising a vent proximate one of the at least one neck ligatures, wherein the vent allows fluid communication through at least one sidewall when the enclosure is not in the deployed configuration, and is held closed by the at least one neck ligature when the enclosure is in the deployed configuration.

8. The outdrive engine enclosure of claim 6, further comprising at least one unidirectional valve embedded within at least one sidewall, each of the at least one unidirectional valve having a flow direction and oriented such that the flow direction is leaving the enclosure.

9. The outdrive engine enclosure of claim 6, further comprising:

at least one veliger inhibitor pocket positioned on at least one sidewall inside the enclosure; and a veliger inhibitor releasably coupled inside each of the at least one veliger inhibitor pocket, each veliger inhibitor being one of a deoxygenator and a veliger poison.

10. The outdrive engine enclosure of claim 6, wherein the at least one sidewall consists of PVC coated fabric, and wherein the PVC coating is external to the enclosure.

11. The outdrive engine enclosure of claim 6, wherein the at least one neck ligature comprises two neck ligatures.

12. The outdrive engine enclosure of claim 6, wherein the transom ligature and the at least one neck ligature each comprise a nylon strap coupled to a buckle, each nylon strap slidably coupled to the at least one sidewall through a plurality of loops.

13. The outdrive engine enclosure of claim 6, wherein at least one of the at least one neck ligature and the transom ligature comprises an elastic material.

14. The outdrive engine enclosure of claim 6, wherein the at least one sidewall comprises a top sidewall, a bottom sidewall, and two side sidewalls.

15. The outdrive engine enclosure of claim 6, further comprising:

a transom section comprising the open mouth, the transom ligature, and a first portion of the at least one sidewall, the transom section coupled to a neck section along a first junction, the neck section comprising the at least one neck ligature and a second portion of the at least one sidewall; and a prop section coupled to the neck section along a second junction and comprising the closed end and a third portion of the at least one sidewall;

wherein the enclosure at the first junction narrows along at least a first path and the enclosure at the second junction expands along at least a second path.

16. A method for inhibiting the biofouling of an outdrive engine, comprising:

running the outdrive engine until an internal temperature of at least 130° F. is reached;

pulling an outdrive engine enclosure over a distal end of the outdrive engine such that a skeg and a prop of the engine pass through an open mouth of the outdrive engine enclosure, the enclosure comprising at least one sidewall forming the open mouth and a closed end opposite the open mouth;

sliding the outdrive engine enclosure up along the outdrive engine until the open mouth is proximate a transom through which the engine is coupled and the prop is proximate the closed end;

coupling the enclosure to the transom by constricting a transom ligature coupled circumferentially about and proximate to the open mouth until the at least one sidewall proximate the open mouth is pressed against at least one of a transom mounting rim and a gimbal housing to form a transom seal that is substantially watertight;

reducing a volume of water trapped inside the enclosure with the engine by constricting at least one neck ligature coupled circumferentially about the at least one sidewall between the open mouth and the closed end, thereby pressing the at least one sidewall against the outdrive engine proximate a neck of the outdrive engine and placing the enclosure into a deployed configuration;

wherein the neck of the outdrive engine is defined by a smallest circumference around the outdrive engine that passes between a cavitation plate and a cowling above the cavitation plate.

17. The method of claim 16, wherein putting the outdrive engine enclosure into the deployed configuration is accomplished within 10 minutes or less of the engine achieving the internal temperature of at least 130° F.

18. The method of claim 16, further comprising placing a veliger inhibitor inside each of at least one veliger inhibitor pocket before pulling the enclosure over the distal end of the engine, each of the at least one veliger inhibitor pocket positioned on the inside of the enclosure and each veliger inhibitor being one of a deoxygenator and a veliger poison.

19. The method of claim 16, further comprising placing a visual reminder to prevent accidental engagement of the prop while the prop is inside of the enclosure.

20. The method of claim 16, further comprising raising the outdrive engine into a raised position.

* * * * *